US005839726A

United States Patent [19]

Luise

[11] Patent Number: 5,839,726

[45] **Date of Patent: *Nov. 24, 1998**

[54] CASINO TABLE GAME

[75] Inventor: John Martin Luise, West Midlands, England

[73] Assignee: Mark Solo Limited, Birmingham, England

[ * ] Notice: This patent issued on a continued prosecution application filed under 37 CFR 1.53(d), and is subject to the twenty year patent term provisions of 35 U.S.C. 154(a)(2).

[21] Appl. No.: 745,745

[22] Filed: Nov. 12, 1996

[30] Foreign Application Priority Data

Aug. 28, 1996 [GB] United Kingdom ..... 9617891

[51] Int. Cl.[6] ..... A63F 3/00

[52] U.S. Cl. ..... 273/246; 273/309

[58] Field of Search ..... 273/246, 248, 273/249, 268, 274, 277, 146, 309

[56] References Cited

U.S. PATENT DOCUMENTS

| | | | |
|---|---|---|---|
| 1,797,742 | 3/1931 | Ward | 273/246 |
| 3,889,954 | 6/1975 | Malisow | 273/274 X |
| 4,042,245 | 8/1977 | Zarour . | |
| 4,060,246 | 11/1977 | Ward . | |
| 4,199,147 | 4/1980 | Stansberry | 273/274 |
| 4,729,568 | 3/1988 | Welsh | 273/246 |
| 4,887,819 | 12/1989 | Walker | 273/274 X |
| 4,890,843 | 1/1990 | Chauve | 273/246 |
| 4,917,386 | 4/1990 | Tozer | 273/274 X |
| 4,986,546 | 1/1991 | Cerulla | 273/240 |
| 5,092,605 | 3/1992 | Hoffman | 273/246 |
| 5,149,101 | 9/1992 | Mazza et al. | 273/246 |
| 5,226,655 | 7/1993 | Richabaugh | 273/246 |
| 5,308,081 | 5/1994 | Bartle | 273/274 |
| 5,398,938 | 3/1995 | Money | 273/237 |

FOREIGN PATENT DOCUMENTS

| | | | |
|---|---|---|---|
| 1263875 | 12/1989 | Canada | 273/246 |
| 1070900 | 6/1967 | United Kingdom . | |
| 1274603 | 5/1972 | United Kingdom . | |
| 2239811 | 7/1991 | United Kingdom . | |
| 2 253 568 | 9/1992 | United Kingdom | A63F 3/00 |

OTHER PUBLICATIONS

Crap Shooting; Foster's Complete Hoyle, An Encyclopedia of Games;R. F. Foster; F. B. Lippincott Company, 1963; pp. 578–579.

Hazard; Scarne's Encyclopedia of Games; John Scarne; Harper & Row, Publishers, 1973; pp. 474–475.

Hazard; Scarne's New Complete Guide to Gambling; John Scarne; Simon and Schuster, 1974; pp. 507–508.

The Dictionary of Gambling and Gaming; Thomas L. Clark; Lexik House Publishers, 1987; p. 104.

Win, Place, Show and Exotic Bets; Scarne's New Complete Guide to Gambling; John Scarne; Simon and Schuster, 1974; pp. 39–41.

(List continued on next page.)

*Primary Examiner*—William E. Stoll
*Attorney, Agent, or Firm*—Gardner, Carton & Douglas

[57] ABSTRACT

The present invention provides a dice game having a horse-racing theme which includes a number of horses in the race the number of which corresponds to the number of sides of a single die. In play, preferably 3 dice are used. When a number representing a horse is rolled by any of the dice used, that horse is moved a distance referred to as a "furlong." If the horse's number appears on more than one die in a single roll, then the horse is moved a comparable number of furlongs. For example, if 3 dice are used and the numbers 6-6-2 are rolled, the number 2 horse moves 1 furlong, while the number 6 horse moves 2 furlongs. Thus, each horse begins a race with equal odds of winning, and each horse must go the same distance in order to complete the race. The present invention provides for standard horse racing wagers on the eventual outcome of the race, such as win, place, and show. The present invention further provides for a series of wagers, referred to as "betting-in-running," which can be placed on the outcome of each roll of the dice.

23 Claims, 3 Drawing Sheets

OTHER PUBLICATIONS

The International Dictionary of Sports and Games; J. A. Cuddon; Schocken Books, 1979; p. 406.

"Luck may be a lady but she won't roll dice"; The San Diego Union–Tribune, Copyright 1994; Oct. 7, 1994; p. E–2.

"The nature of games" ; Cornell Hotel & Restaurant Administration Quarterly; Copyright 1995; Apr. 1995; vol. 36; No. 2; p. 84.

"Really Nasty" Horse Racing Game; Upstarts!; Ipswich, IP3 9RU, United Kingdom; Copyright 1989.

"And They're Off!"; The Really Useful Games Company; London WC2H 9NS, United Kingdom; Copyright 1993.

Dice Games; The Encyclopedia Americana International Edition; vol. 9; Grolier Incorporated; pp. 73–74; 1991.

Winner's enclosure
1 st.
2 nd.
3 rd.
TRIO pays 16 to 1
QUINELA pays 12 to 1
82
84
86
54
52
38
INTERNATIONAL 5 fur
CASINO 4 fur
RACING 3 fur
2 fur
1 fur
CITATION
SEA BIRD
SCEPTRE
ROBERTO
KELSO
ECLIPSE
6
5
4
3
2
1
24
36
22
34
20
32
18
30
16
28
14
26
12

Betting in running
Any horse moving
2 furlongs 6 to 5
3 furlongs 16 to 1
Not moving
Named horse moving
Eclipse
Kelso
Roberto
Sceptre
Sea bird
Citation
100-1
12-1
8-5
3-5
exactly 3 fur
exactly 2 fur
exactly 1 fur
not moving
colour 25 marker
colour 5 marker
win
show
place
QUINELA
TRIO
2 WAY
4 to 5
3 WAY
9 to 5
PHOTO FINISH
Photo
9 to 2
9 to 5
4 to 5
6-1
5-1
4-1
3-1
2-1
6-3
6-2
5-2
4-2
3-2
6-5
6-4
5-4
4-3
6-3-1
6-2-1
5-2-1
4-2-1
3-2-1
6-5-1
6-4-1
5-4-1
5-3-1
4-3-1
6-4-2
5-4-2
5-3-2
4-3-2
6-5-2
6-5-4
6-5-3
5-4-3

CASINO TABLE GAME

FIELD OF THE INVENTION

The present invention relates in general to casino table games and, in particular, to a casino table game having a horse-racing theme.

BACKGROUND OF THE INVENTION

Games of chance in which players wager on the outcome of thrown marked cubes known as dice are one of the oldest gambling exercises known to man. The dice are symmetrical, with equally rounded edges and faces marked with numbers from one to six. The sum of the spots on opposite faces of a die always total 7. Thus, the number 3 will appear opposite the number 4, while the number 6 will appear opposite the number 1.

When rolling or "casting" a die, the chance, or odds, that any specific number will appear is 1 in 6. When two dice are thrown, the spots can appear in 36 different combinations. With 3 dice, the spots can appear in 216 different combinations. Various dice games are known in the art. One such dice game is the 700 year-old English game of "Hazard."

It is believed that, while laying siege to an Arabian castle, English soldiers on the Crusades invented a dice game which they called Hazard. By the 17th and 18th centuries, the game had achieved considerable popularity in London's gambling circles. In Hazard, 2 dice were dropped through a device called a Hazard chute, which included a series of inclined planes called steps. This caused the dice to tumble as they went through the chute onto the playing surface. Later, a chuck-a-luck cage in which the dice were tumbled became a substitute for the Hazard chute. Alternatively, the dice were simply thrown by a player known as a "caster" onto the playing surface from a cup. While various derivations of the game exist, the game is generally described below.

To start a game of Hazard, the first player would cast the two dice using one of the methods described above. The object was to roll a 5, 6, 7, 8 or 9, or in the language of the game, to fall within the "main." If the player rolled outside the main, he would continue to roll until a number in the main was rolled. Once a number in the main had been rolled, this number became the "main point." With the main point established, the caster would throw the dice until a 4, 5, 6, 7, 8, 9 or 10 was rolled. This number would become the "chance point."

Following the establishment of the main point, when throwing to determine the chance point, the caster would lose his bet immediately if he threw an "out." If the main point was a 5 or a 9, a throw of 11 or 12 was an out. If the main point was a 6 or an 8, a throw of 11 was an out. If the main point was a 7, a throw of 12 was an out. A throw of 2 or 3 was an out regardless of the main point. A throw of 2 or 3 was known as "crabs."

When throwing for the chance point, if the caster duplicated the main point, the caster would win the bet. If the main point was a 6 or an 8, the caster would win his bet by throwing a 12. If the main point was a 7, the caster would win his bet by throwing an 11. Winning by any manner above when throwing for the chance point was referred to as "nicks."

If the caster threw neither an out nor a nick while throwing for the chance point, the caster would continue to throw until the chance point was determined. The caster then would continue to throw the two dice until he either duplicated the chance point, thereby winning the bet, or threw the main point, thereby losing the bet.

The game of Hazard never enjoyed widespread popularity in the United States. However, around 1800 in New Orleans, La., Hazard was refined to a new game of dice. This new game was referred to as "Craps," a name derived from the lowest throw in Hazard, crabs.

In Craps, the caster rolls 2 dice. If the caster's first roll is a 7 or 11, the caster wins. This is referred to as a "natural." If on the first roll the sum of the dice is a 2, 3 or 12, the caster loses. This is referred to as "craps." If the caster rolls a 4, 5, 6, 8, 9 or 10, the number is established as his "point." The caster continues to roll until he either matches his point and wins, or rolls a 7 and loses.

Dice games which utilize a horse-racing theme also are known in the art. In the simplest form of such dice games, each of 11 horses is assigned a number from 2 to 12, representing the possible rolls of a pair of dice. After each roll of the dice, the number rolled results in the movement of that horse towards a finish line. The odds of each horse winning the race is determined by the probability that the number assigned to the horse will be rolled. Thus, for example, the horse represented by the number 5 has odds half as favorable as the horse represented by the number 3, because combinations leading to the number 5 are twice as likely to occur as combinations leading to the number 3. Such dice games suffer from the disadvantages of being predictable in that the horses having numbers which have the highest probability of being rolled usually win the race. In addition, such games suffer from the drawback that the players can only bet once per race, on the eventual outcome of the race.

In a variant of a dice game with a horse-racing theme, the differences in the odds of the dice rolling the numbers are equalized by varying the number of movements each horse must make to complete the race. While this game equalizes the probability of winning the race for each horse, it is dissatisfactory because the simulation of the horse race suffers as each horse, in effect, races a different distance. In addition, like the variant described above, this game only allows players to bet once per race, on the eventual outcome of the race.

It thus would be advantageous to have a dice game having a horse-racing theme in which each horse has the same odds of winning the race. It would be additionally advantageous that such game accurately simulates an actual horse race in requiring each horse to complete the same distance to finish the race. In addition, it would be further advantageous to allow the players not only to bet on the outcome of each race, but also to place additional bets during the pendency of the race. Still further, such game should be easy to understand and play, even for novice players. Finally, such game should provide fair and equitable odds of winning to the players while allowing the house to achieve a satisfactory return.

BRIEF DESCRIPTION OF THE INVENTION

The present invention provides a dice game having a horse-racing theme which accurately simulates an actual horse race in that each horse completes the same distance in order to finish the race. The present invention provides a dice game having a horse-racing theme in which each horse has the same odds of winning the race. Further, the present invention allows players not only to wager on the outcome of each race, but also to place additional wagers during the pendency of the race. Still further, the present invention provides a game which is easy to understand and play, even for the novice player. Finally, the present invention provides fair and equitable odds to the player while allowing the house to achieve a satisfactory return.

The present invention achieves these objectives by providing horses the number of which corresponds to the number of sides of a single die. In play, preferably 3 dice are used. When a number representing a horse is rolled by any of the dice used, that horse is moved a distance referred to as a "furlong." If the horse's number appears on more than one die in a single roll, then the horse is moved a comparable number of furlongs. For example, if 3 dice are used and the numbers 6-6-2 are rolled, the number 2 horse moves 1 furlong, while the number 6 horse moves 2 furlongs. Thus, each horse begins a race with equal odds of winning, and each horse must go the same distance in order to complete the race.

The present invention provides for standard horse racing wagers on the eventual outcome of the race, such as win, place, and show. The present invention further provides for a series of wagers, referred to as "betting-in-running," which can be placed on the outcome of each roll of the dice.

DETAILED DESCRIPTION OF THE INVENTION

It is a particular advantage of the present invention that the game layout and the color coordination of the game were devised to make the game easily understandable by players of limited gaming experience. The game layout and the color combinations also facilitate understanding by casino personnel, thus adding to the ease of operation. This ease of operation is achieved by the particulars of the game layout, which includes a play-panel and a wager-panel.

Figure 1:
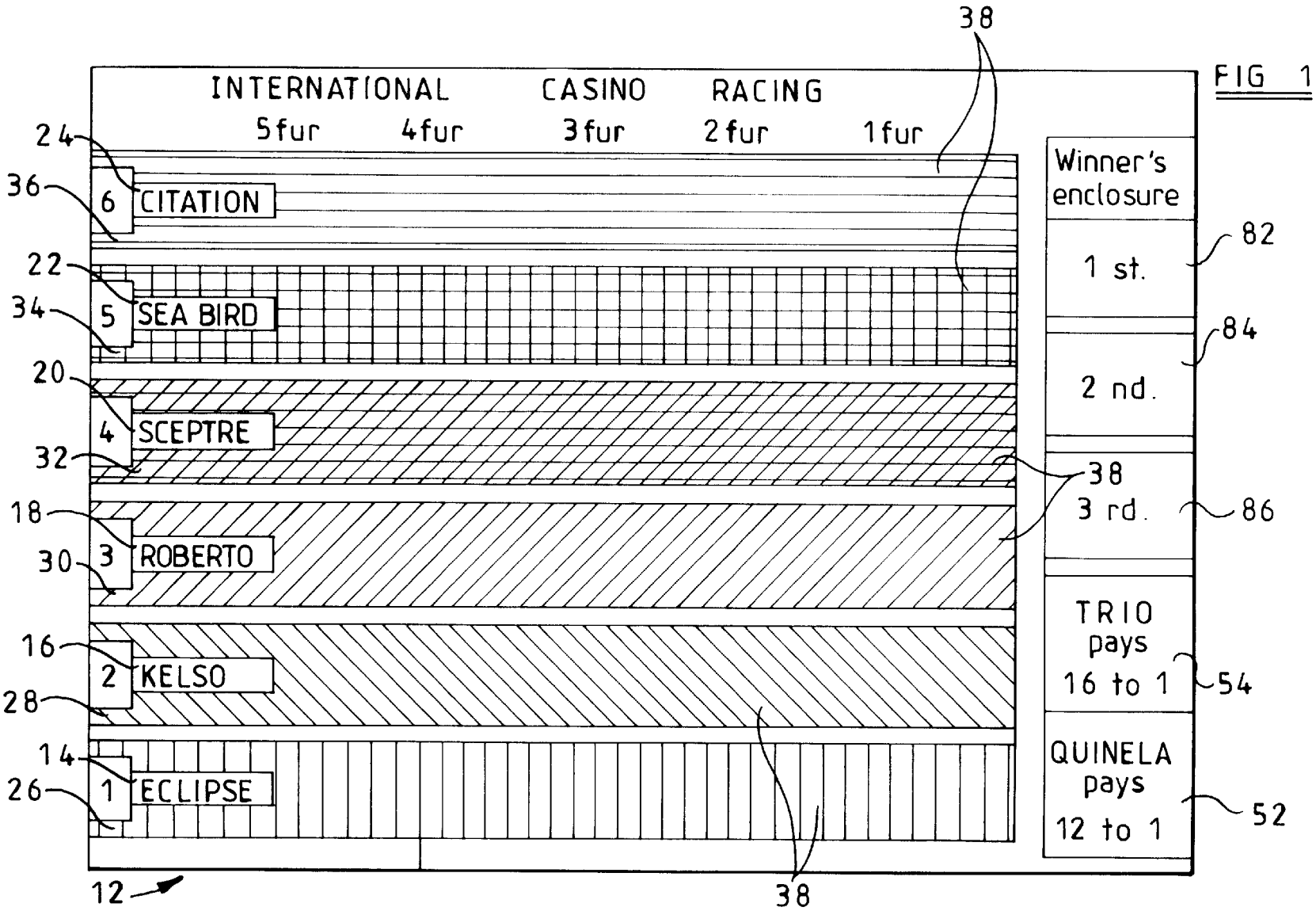
FIG. 1 is an embodiment of a play-panel made in accordance with the principles of the present invention.

Referring first to FIG. 1, a play-panel 12 made in accordance with the principles of the present invention is seen. The play-panel 12 includes the numerical identification of the horses involved in the simulated horse race. The number of horses involved corresponds with the number of sides of a die. Thus, in the preferred embodiment, 6 horses corresponding to the 6 sides of a standard die are utilized.

To further simulate horse racing, each of the 6 horses is assigned a name and color. Thus, in the example seen in FIG. 1, the well-known horses with the names Eclipse 14, Kelso 16, Roberto 18, Sceptre 20, Sea Bird 22, and Citation 24 are utilized. In addition, each of the horses is assigned a color. This generally simulates the use in actual horse racing of different color combinations to aid in player identification during the race. Thus, again in the example depicted in FIG. 1, the color brown 26 is assigned to the number 1 horse, the color gray 28 is assigned to the number 2 horse, the color red 30 is assigned to the number 3 horse, the color purple 22 is assigned to the number 4 horse, the color green 34 is assigned to the number 5 horse and the color blue 36 is assigned to the number 6 horse. As described in detail below, in order to aid in understanding and playing the dice game of the present invention, the assignment of the name and the color to the horse coordinates with the placing of bets on the betting panel.

Of course, the colors described herein are meant as examples and the present invention contemplates the use of any colors. In addition, while the present invention contemplates races of any distance, in the preferred embodiment depicted in FIG. 1, a 5- furlong race is described. The play panel includes for each horse a representation 38 of the distance of the race. As described in detail below, when the number assigned to a particular horse is rolled, that horse advances 1 furlong.

Prior to the initiation of the race, players can bet on the eventual outcome of the race. Such betting is designed to simulate the actual betting on a live horse race. Thus, players can bet which horse will win the race, which horse will finish in the top two or "show," and which horses will finish in the top three or "place."

Figure 2:
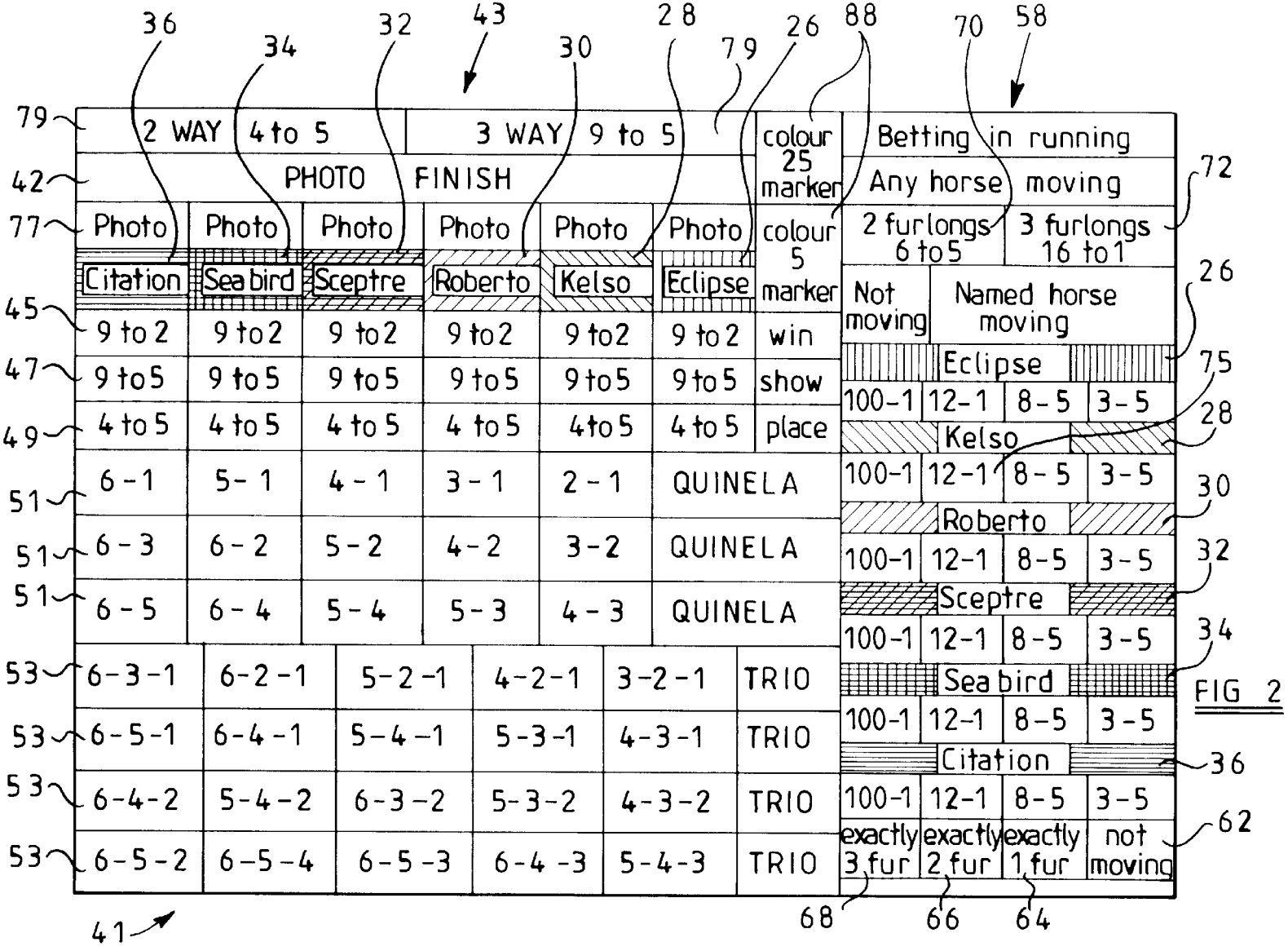
FIG. 2 is an embodiment of a wagering-panel made in accordance with the principles of the present invention.

In order to place the bet, the player places the wager in the box found in a wager-panel 41 corresponding to win, place or show for each of the six horses. As seen in FIG. 2, the wager-panel 41 includes a first betting area 43 for bets on the final outcome of the race. The first betting area 43 includes rows which identify each of the horses and columns which represent different bets. Thus, boxes onto which players place their bets are defined for each bet. Such boxes include the payoff odds for each of the various bets. Thus, the odds are 9 to 2 that any given horse will win 45, 7 to 4 that any given horse will show 47, and 5 to 6 that any given horse will place 49.

In addition, in order to further simulate actual betting at the track, players can bet on which two horses will occupy the first and second places in either order. This is referred to in British horse-racing nomenclature as a "dual forecast" and in United States horse-racing nomenclature as a "quiniela" 51. In order to place a dual forecast bet, bets are placed in the boxes indicating which of the horses are predicted to finish in the first two slots. In order to facilitate understanding and ease of play, each horse number is color-coordinated with the color assigned to the particular horse. Thus, for example, in the box 50 containing the dual forecast of the number 1 and number 6 horses, the number 1 is brown and the number 6 is blue. The odds of any given two horses finishing in first or second place is 12 to 1, as set forth in an information box 52 on the play-panel.

Likewise, the player can bet on which three horses will finish in the first three places in any order. Such bet is referred to in British racing nomenclature as a "trio" and in United States racing nomenclature as a "box trifecta" 53. Again, the bettor places a trio bet by putting the wager on the box containing the horse numbers which are predicted to finish in the first three places. Again, the numbers of the horses are color-coordinated with their assigned colors for ease of play. The odds of any given three horses finishing in first, second and third place are 16 to 1, as set forth in an information box 54 on the play-panel.

While not specifically included in the presently described embodiment, the present invention contemplates use of additional so-called "exotic bets" on the eventual outcome of the race. Examples of such exotic bets include a "daily double" in which the player bets on the winners of any two consecutive races, an "exacta" in which the player bets on the first two places in the order selected, and a "trifecta" in which the player bets on the first three places in the order selected.

While depicted herein for ease of description as a separate play-panel 12 and wager-panel 41, the present invention is preferably designed to be used as a casino play-table.

Figure 3:
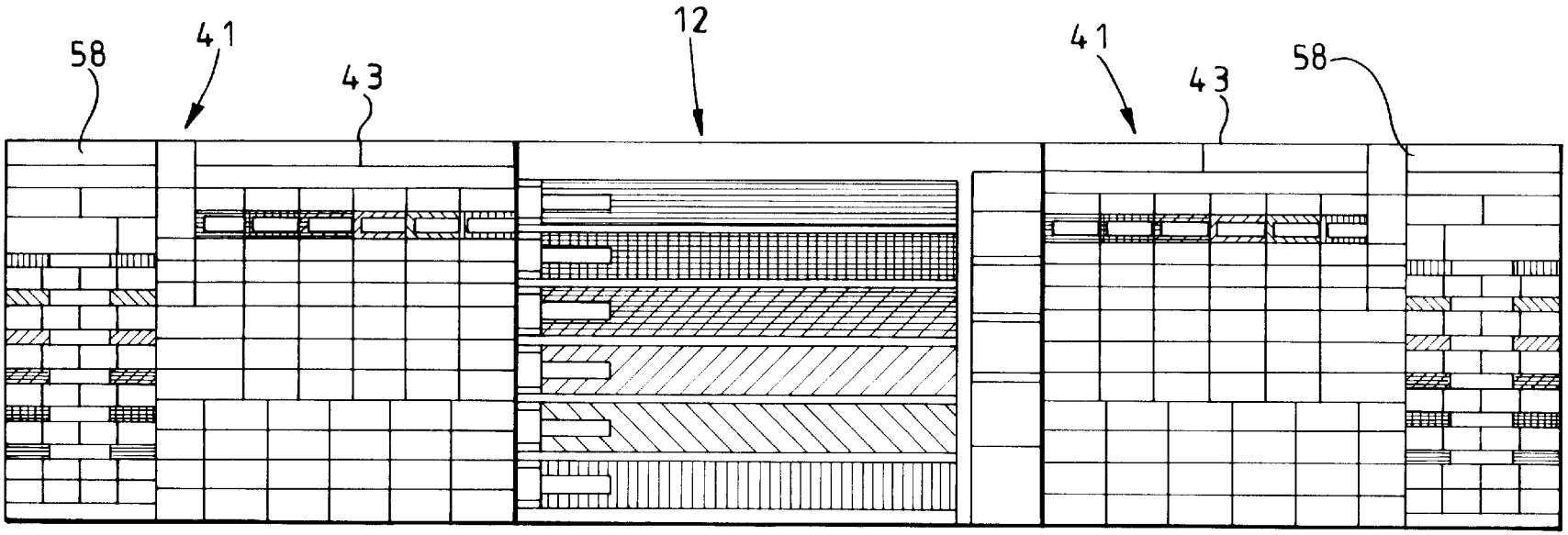
FIG. 3 is the preferred layout of a casino table game made in accordance with the principles of the present invention.

Referring to FIG. 3, in the preferred embodiment, the play-panel 12 is set forth on the felt cover of the play area onto which the dice are cast. In addition, the preferred embodiment includes two wager-panels 41 positioned on each side of the play-panel 12 for ease of access to multiple players. In order to retain the dice on the play surface, the play table preferably includes side panels in accordance with the standard Craps table. While developed for application in the preferred embodiment as a banker's table game in a casino setting, alternative embodiments such as board games are considered to be within the scope of the invention.

In addition, use of any number of dice is contemplated in the present invention. In a preferred embodiment, at least 2 dice are used, so that the possibility exists of each horse moving more than one length in any given roll. In the presently preferred embodiment, 3 dice are used, thus creating the possibility that any given horse could move three lengths in a single roll of the dice. Additionally, the use of multiple dice enables various combination wagers to be placed, as described in detail below. However, it is believed that the use of more than 3 dice would create confusion for many players thus resulting in the preferred number of dice as 3.

When all initial bets have been placed, the race begins. In the preferred embodiment, the game contemplates use of an "inspector" who manages the race and at least one "dealer" who manages the wagering. In order to add excitement and to further simulate actual horse racing, after announcing "no more bets" to signify the close of the initial betting, the dealer can announce "under starter's orders-there off." consistent with the start of an actual horse race.

To initiate the race, the dice are cast. While the game can be played with a standard die, in a preferred embodiment the die faces are colored to correspond to the colors of the six horses. In a preferred embodiment, the dice can be tumbled in a standard chuck-a-luck cage positioned in the center of the table, which is operated by the dealer. Alternatively, as in craps, to increase the excitement of the game a player can be assigned responsibility as the caster and can throw the three dice on the table. If the dice are thrown by the player, a die stick can be used to collect the dice and move the horses.

The inspector will announce the winning numbers, preferably in descending order, then move the horses according to the result. For example, if the three dice have rolled a 6, a 3, and a 1, the number 6, number 3, and number 1 horses will each move forward one furlong.

Alternatively, for example, if the dice have rolled a 5, a 5, and a 2, the number 2 horse will move one furlong while the number 5 horse will move two furlongs. Again, in order to simulate an actual horse race and to add excitement to the game, the dealer will announce the positioning of the horses during a race, using such standard race nomenclature as "Seabird was very slow away" to designate that the number 5 horse has not moved, "Citation is clear out in front" to designate that the number 6 horse has moved into the lead, etc.

It is a particular advantage of the present invention that, in addition to betting on the final outcome of the race, the players also can bet on the results of any single throw. These "betting-in-running" bets are made in the betting-in-running area 58 of the wager panel 41. The betting-in-running area 58 of the wager-panel 41 includes rows identifying each horse and columns for each specific bet. The betting-in-running bets preferably include bets that a specific horse will not move 62, that a specific horse will move exactly one furlong 64, that a specific horse will move exactly two furlongs 66, that a specific horse will move exactly three furlongs 68, that any horse will move exactly two furlongs 70, and that any horse will move exactly three furlongs 72. As with the betting on the outcome of the race, for ease of play, the betting-in-running area includes the horse's colors.

In order to place a betting-in-running bet, the wager is placed upon the square corresponding to the desired bet. Again, the box into which the wager is placed sets forth the odds of such bet. In order to bet that the number 2 horse or Kelso will move exactly two furlongs, a bet is placed on the "two furlongs" box 75 which includes the odds of such bet. Likewise, to bet on any horse moving three furlongs, the wager is placed on the box containing the odds of such bet.

Upon the conclusion of the toss of the dice and the announcement of the results, the dealer will remove all losing bets from the betting-in-running section 58 and pay all winning bets. When all winning bets have been paid, the dealer can call for the players to place their betting-in-running bets, after which additional betting-in-running wagers can be placed. While the race is running, no further bets can be placed on the conclusion of the race. In the preferred embodiment of a casino table game seen in FIG. 3, the betting-in-running areas 58 of the wager-panels 41 are contained at the outside edges of the table, away from the center play-panel 12. This positioning provides greater access to players of the more frequent betting-in-running wagers.

If two horses simultaneously reach the finish line, a "photo finish" has occurred, which is announced by the inspector. Upon a photo finish, additional bets can be placed. Initially, the dealer will clear all losing betting-in-running wagers and pay any betting-in-running winning wagers. The dealer will then announce that betting on the photo finish is allowed. To bet on which horse in a photo finish will win, the wagers are placed in the horses' respective photo box 77 contained in the photo finish portion 42 of first betting area 43 of the wager-panel 41.

After all wagers on the photo finish have been placed, the inspector will announce the close of the betting. A single die is thrown until one of the horses involved in the photo finish is rolled. The dealer will then remove any losing photo finish bets and pay the winning photo finish bets. If two horses finished the race simultaneously, a photo finish will be declared regardless of whether one of the simultaneously finishing horses has an additional furlong shown on the dice. For example, if horse number 5 and horse number 6 are both on the one-furlong line, and the result of the cast is 6-6-5, the race remains a photo finish despite the fact the roll of the dice has indicated that the number 6 horse moves two furlongs. The odds for the photo finish are contained in information boxes 79 on the wager-panel 41.

Again, in order to accurately simulate a horse race and to add excitement to the proceedings, the inspector can announce the conclusion of the race with standard racing terminology such as "Inside the final furlong, it's neck and neck" to indicate a close finish, "Eclipse is gone clear entering the final furlong" to indicate that the number 1 horse is pulling into the lead, "It's a photo finish" to indicate a photo finish, etc.

The race continues until all three places have been decided. When first place is established, the dealer clears all losing bets on the "win" line. When second place is established, the dealer clears all losing bets on the "show" line and dual forecast bets. When third place is established, the dealer clears all losing bets on the "place" line and all losing trio bets. When all losing bets have been removed, the dealer pays out the winning bets. When all bets have been paid, the inspector replaces the horses on the track and, once again to simulate actual horse racing and to generate excitement, announces the post time of the next race. Upon winning the race, the winning horse is placed in the winner's enclosure in the first position 82. Likewise, the second and third horses are placed in the winner's enclosure in the second 84 and third 86 positions.

While the game can be played with cash, in a preferred embodiment, the game is played with chips. In the preferred embodiment, different colored chips are assigned to different players so that the dealer can track each player's bets. In the preferred embodiment, the wagering panel includes color marker boxes 88 which allow players to designate different values to their respective colored chips.

It is a particular advantage of the present invention that a large number of bets can be placed at any given time relative to the other casino table games. In the embodiment depicted herein, thirteen different bets can be placed. In addition, of the thirteen bets, six bets can be placed preceding any roll of the dice. The large number of available bets enables the house to maintain profitable operations while still offering fair and equitable margins to the players. As an example, a table designating the payoff odds, the true odds and the variance for each of the different bets of the preferred embodiment described herein is set forth below. As seen in the table below, the variance between the true odds and the payoff odds is quite small relative to other casino table games.

| | Odds | Odds % | True Odds | True % | Variance % |
|---|---|---|---|---|---|
| To Win - 1st horse past the post paid at | 9–2 | 18.18 | 5–1 | 16.66 | 1.52 |
| To Show - 1st or 2nd horse past the post paid at | 9–5 | 35.71 | 2–1 | 33.33 | 3.38 |
| To Place - 1st or 2nd or 3rd past the post paid at | 4–5 | 55.55 | 1–1 | 50.00 | 5.55 |
| Quinela - 1st and 2nd in either order | 12–1 | 7.69 | 14–1 | 6.66 | 1.03 |
| Trio - 1st, 2nd and 3rd past the post in any order | 16–1 | 5.88 | 19–1 | 5.00 | 0.88 |
| Winner of a 3-way photo finish paid at | 9–5 | 35.71 | 2–1 | 33.33 | 3.38 |
| Winner of a 2-way photo finish paid at | 4–5 | 55.55 | 1–1 | 50.00 | 5.55 |
| Named horse moving exactly 1 Furlong | 8–5 | 38.46 | 141–75 | 34.72 | 3.74 |
| Named horse moving exactly 2 Furlongs | 12–1 | 7.69 | 201–15 | 7.46 | 0.23 |
| Named horse moving exactly 3 Furlongs | 100–1 | 0.091 | 215–1 | 0.046 | 0.045 |
| Named horse not moving | 3–5 | 62.50 | 91–125 | 57.87 | 4.63 |
| Any horse moving exactly 2 Furlongs | 6–5 | 45.45 | 126–90 | 41.66 | 3.79 |
| Any horse moving exactly 3 Furlongs | 16–1 | 5.88 | 35–1 | 2.78 | 3.10 |

It should be understood that various changes in modifications to the preferred embodiment described herein will be apparent to those skilled in the art. Such changes and modifications can be made without departing from the spirit and scope of the present invention and without diminishing its attendant advantages. It is therefore intended that such changes and modifications be within the scope of the claims.

One such change within the scope of the present invention would be to substitute a different racing competitor for the horses. For example, in the United Kingdom where dog racing is a popular form of entertainment and is used as a vehicle for bets and wagers, the horses could be replaced by dogs. Of course, any other form of competitor such as a racing car or a track athlete or a cyclist could be substituted for the horse or dog.

What is claimed is:

1. A game of chance comprising:

a plurality of dice, with each die comprising a given number of sides; and a playing surface, the playing surface including a play-panel having an identification of a plurality of competitor numbers corresponding to the number of sides of the dice; and the playing surface further including a wager panel having a first betting area for bets on the final outcome of a race and a second betting area for bets on the outcome of a roll of the dice.

2. The game of chance of claim 1 wherein the first betting area further includes at least one row identifying at least one of the plurality of competitors and at least one column representing a bet on the final outcome of the race.

3. The game of chance of claim 2 wherein the competitors are each assigned a color and the row of the first betting area is color matched to the competitor.

4. The game of chance of claim 1 wherein the second betting area further includes at least one row identifying at least one of the plurality of competitors and at least one column representing a bet on the outcome of a roll of the dice.

5. The game of chance of claim 3 wherein the competitors are each assigned a color and the row of the second betting area is color matched to the competitor.

6. The game of chance of claim 1 wherein the competitors are assigned a number corresponding to the numbers assigned to each side of a die.

7. The game of chance of claim 1 wherein the competitors include an assigned color.

8. The game of chance of claim 7 wherein the wager-panel is color coordinated with the assigned colors.

9. The game of chance of claim 7 wherein the sides of the dice are color coordinated with the assigned colors.

10. The game of chance of claim 1 wherein the paying surface is contained on a casino table game.

11. The game of chance of claim 10 wherein the playing surface includes two wager-panels.

12. The game of chance of claim 1 wherein the second betting areas are contained on an outer periphery of the casino table game.

13. The game of chance of claim 1 wherein the plurality of dice is 3.

14. The game of chance of claim 1 wherein the playing surface further includes a photo finish betting portion.

15. A game board comprising:

a playing portion having an identification of a plurality of competitors and a graphical representation of a length of a race, the length of the race being divided into equal distant segments;

a wager portion having a first betting area for bets on the final outcome of the race, the first betting area including at least one row identifying at least one of the plurality of competitors and at least one column representing a bet on the final outcome of the race; and the wager portion further including a second betting area for bets on the outcome of any roll of the dice, the second betting area including at least one row identifying at least one of the plurality of competitors and at least one column representing a bet on the outcome of a roll of the dice.

16. The game of chance of claim 15 wherein the competitors are each assigned a color and the row of the first betting area is color matched to the competitor.

17. The game of chance of claim 16 wherein the row of the second betting area is color matched to the competitor.

18. The game of chance of claim 15 wherein the competitors are assigned a number corresponding to the numbers assigned to each side of a die.

19. The game of chance of claim 15 wherein the competitors include an assigned color.

20. The game of chance of claim 19 wherein the wager-portion is color coordinated with the assigned colors.

21. The game of chance of claim 19 wherein the sides of the dice are color coordinated with the assigned colors.

22. The game of chance of claim 15 wherein the plurality of dice is 3.

23. The game of chance of claim 15 wherein the wager-portion further includes a photo finish betting portion.

* * * * *